US008622103B2

(12) United States Patent
Melamed

(10) Patent No.: US 8,622,103 B2
(45) **Date of Patent: *Jan. 7, 2014**

(54) TRANSFERRABLE PURSE ORGANIZER

(75) Inventor: Hardeep Melamed, Atlanta, GA (US)

(73) Assignee: Pursen, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/529,442

(22) Filed: Jun. 21, 2012

(65) Prior Publication Data

US 2012/0261041 A1 Oct. 18, 2012

Related U.S. Application Data

(63) Continuation of application No. 12/060,071, filed on Mar. 31, 2008, now Pat. No. 8,225,829.

(60) Provisional application No. 60/908,892, filed on Mar. 29, 2007.

(51) Int. Cl.
*A45C 1/02* (2006.01)
*A45C 3/06* (2006.01)

(52) U.S. Cl.
USPC ..... 150/113; 383/3; 190/103; 190/903

(58) Field of Classification Search
USPC ..... 150/113, 117; 383/2, 67; 190/103, 903, 190/902, 105
See application file for complete search history.

(56) References Cited

U.S. PATENT DOCUMENTS 8,225,829 B2 * 7/2012 Melamed ..... 150/113

* cited by examiner

*Primary Examiner* — Tri Mai
(74) *Attorney, Agent, or Firm* — Robert M. Downey, P.A.

(57) ABSTRACT

A transferable insert for organizing the interior of a bag includes a pair of side walls, a pair of end walls and a bottom wall substantially continuously interconnected so as to define an interior storage compartment, a first and second expansion panel each being operatively moveable between a collapsed position and an expanded position to conform to the width of the interior of the bag, a first and second expansion fastener structured and disposed for holding the respective first and second expansion panels stowed in the collapsed position, and a plurality of pouches within the interior storage compartment for holding and positioning a plurality of objects therein in an organized arrangement. A releasable fastener on each of the pair of end walls may be used for releasably holding one of the pair of end walls in a gusseted position.

13 Claims, 4 Drawing Sheets

TRANSFERRABLE PURSE ORGANIZER

CROSS REFERENCE TO RELATED APPLICATIONS

This application is a continuation patent application of non-provisional patent application Ser. No. 12/060,071, filed on Mar. 31, 2008.

FIELD OF THE INVENTION

The present invention relates to luggage and handbags, and more specifically, a transferable organizer for purses, handbags, tote bags, and the like.

BACKGROUND

The various embodiments of the present disclosure overcome the shortcomings of the prior art by providing a transferable insert for organizing the interior of a bag, such as a handbag. The transferable insert, hereinafter referred to as an organizer insert, stabilizes the contents of the bag, while positioning the contents of the bag for ease of location and removal. The organizer bag includes various means for positioning, such as pouches, pockets, and compartments, is transferable from one bag to another, is freestanding when outside of a bag, and is adjustable to conform to bags of various sizes and shapes.

The organizer insert includes a pair of side walls, a bottom wall, and a pair of end walls that are substantially continuously interconnected so as to define an interior compartment. The organizer insert includes pouches, pockets, compartments, slots, and the like as means for positioning a number of objects enclosed by the bag. The means for positioning are generally distributed along any of the side walls, bottom walls, and end walls such that the position of each of the objects is substantially and reversibly fixed with respect to the opening of the bag. In other words, the person carrying the handbag can easily locate objects, particularly because the means for positioning are often tailored to enclose certain items. For example, the means for positioning may include lipstick pockets, key compartments, eyeglass compartments, and the like. In this fashion, the transferable insert organizes the objects enclosed by the bag.

The handbag organizer may also include a handle for lifting it out of the bag. In the exemplary embodiment, the handle includes two handle straps, each connected along the upper edge of one of the side walls, although the handle may be associated with any one or more of the side walls and end walls. In certain embodiments, or in use with certain handbags, the handle is visible through the opening of the bag.

The bottom wall is connected to at least two of the pair of side walls and the pair of end walls. The organizer insert is expandable to conform to the width of the bag by freeing expansion expansion panels that are stowed using an expansion fastener. The expansion fastener can include any suitable device, including but not limited to, slide fasteners, pressure sensitive fasteners, and hook and loop fasteners such as VELCRO. Either or both of the pair of end walls may be further expandable to conform to the width of the bag by means of releasable fasteners that can releasably hold one of the end walls in a gusseted position.

According to one aspect, at least one of the pair of side walls and the pair of end walls is substantially rigid such that the transferable insert is substantially freestanding.

The foregoing has broadly outlined some of the aspects and features of the present disclosure, which should be construed to be merely illustrative of various potential applications of the disclosure. Other beneficial results can be obtained by applying the disclosed information in a different manner or by combining the disclosed embodiments. Accordingly, other aspects and a more comprehensive understanding of the principles may be obtained by referring to the detailed description of the exemplary embodiments taken in conjunction with the accompanying drawings, in addition to the scope of the disclosure defined by the claims.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

Detailed Description Of The Preferred Embodiments

Figure 1:
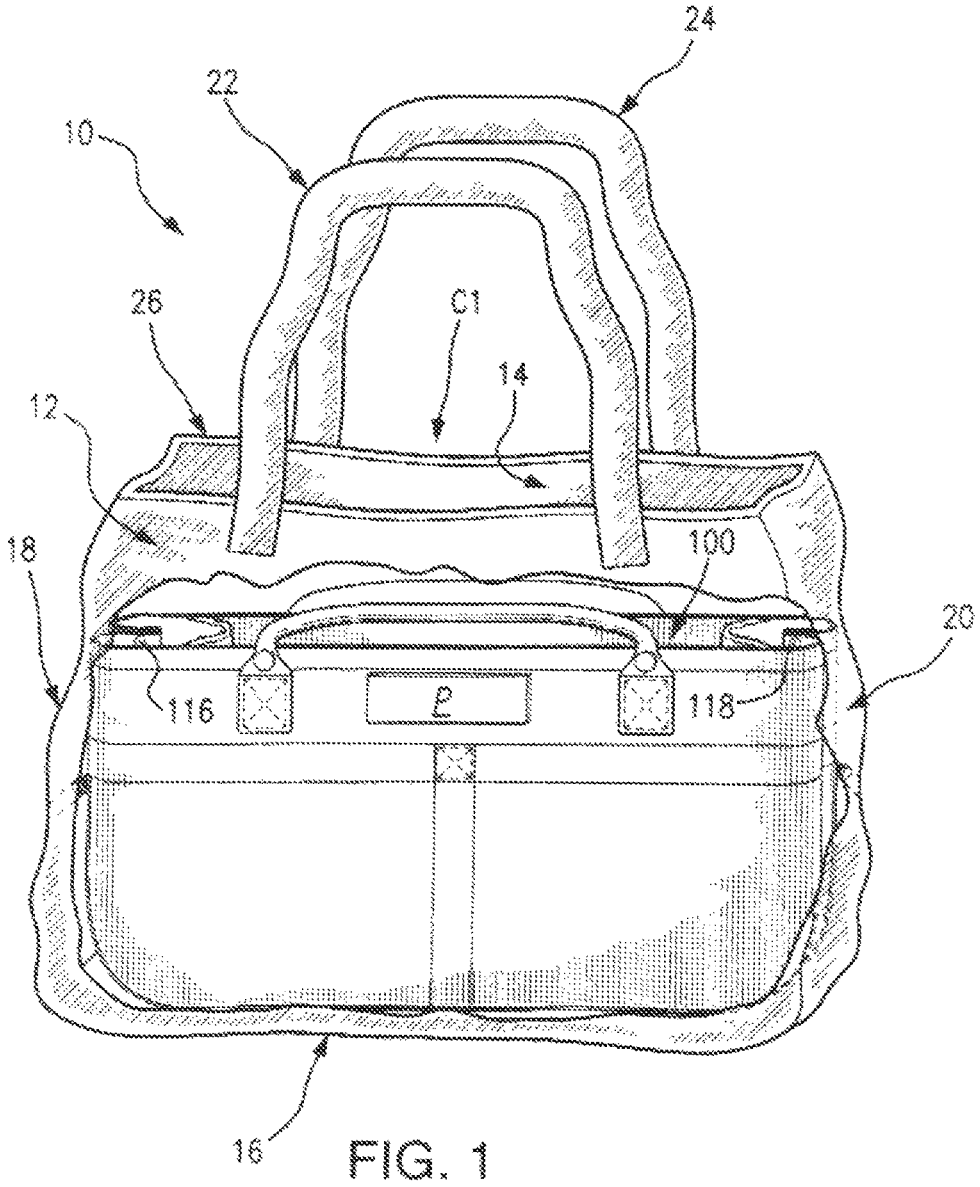
FIG. 1 is a perspective view of an exemplary handbag containing a first exemplary organizer insert, according to an embodiment of the disclosure.
Figure 2:
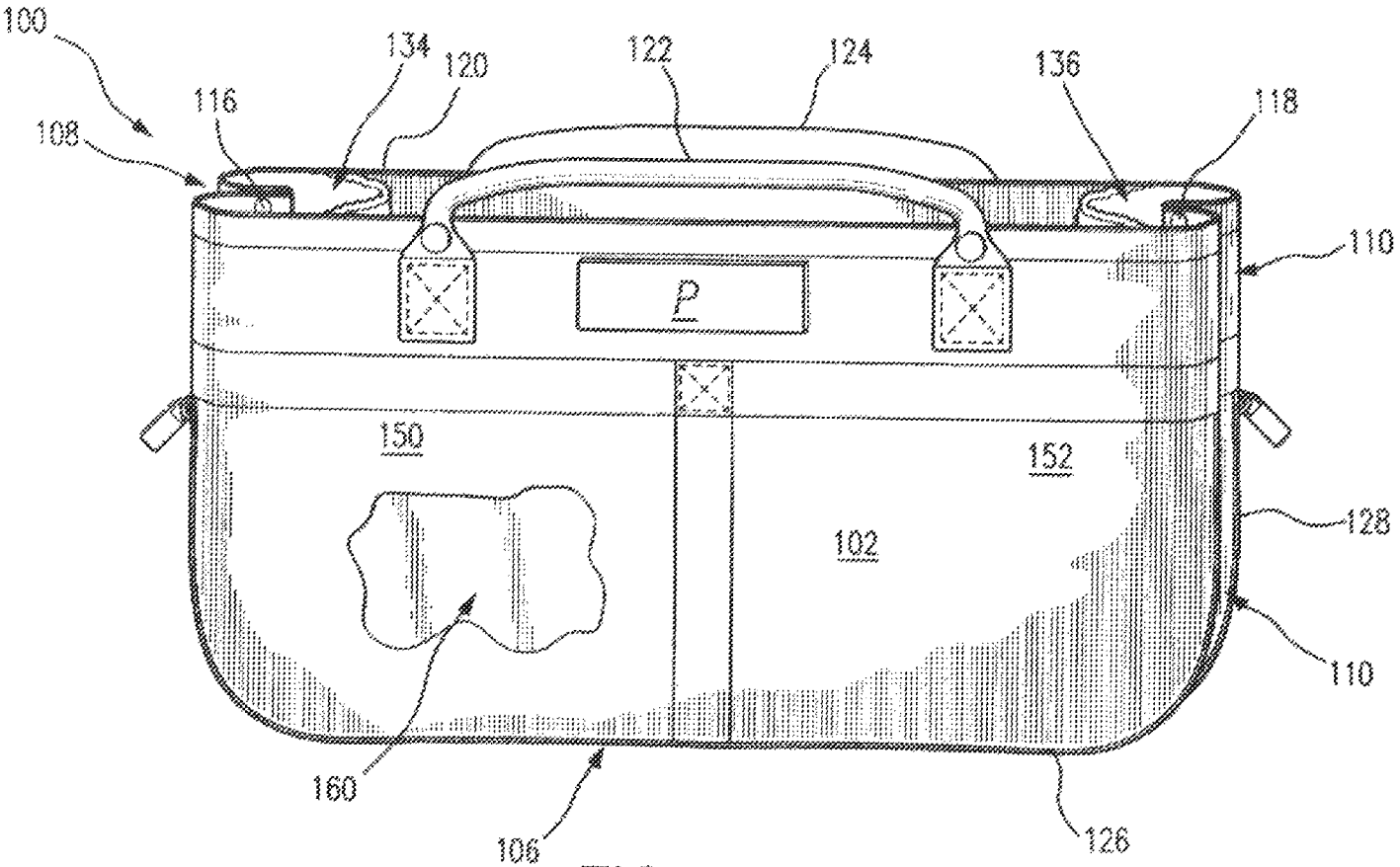
FIG. 2 is a perspective view of the exemplary organizer insert of FIG. 1.

As required, detailed embodiments of the present disclosure are disclosed herein. It will be understood that the disclosed embodiments are merely examples to illustrate aspects that may be embodied in various and alternative forms. The figures are not necessarily to scale, and some features may be exaggerated or minimized to show details of particular components. In other instances, well-known materials or methods have not been described in detail to avoid obscuring the present disclosure. Therefore, specific structural and functional details disclosed herein are not to be interpreted as limiting, but as a basis for the claims and for teaching one skilled in the art to variously employ the present disclosure.

Referring now to the drawings in which like numerals indicate like elements throughout the several views, the drawings illustrate certain of the various aspects of exemplary embodiments of an organizer for personal items carried in a bag or purse, the organizer being transferable among different bags, and adjustable to conform to the dimensions of the different bags and of differently dimensioned items enclosed by the organizer.

FIG. 1 illustrates a bag 1 and an organizer insert 100 for conveniently arranging personal items typically carried in a handbag. The bag 10 is a structured box-style handbag with well-defined walls and an open top, although the principles of the disclosure are applicable to any bag typically carried by an individual, including clutch bags, barrel bags, bucket bags, carpet bags, satchels, duffel bags, tote bags, unstructured handbags, shoulder bags, shopper bags, and the like. Furthermore, alternative bags may include a closure rather than an open top, including top zips, flaps, drawstrings, snaps, buckles, and the like.

The bag 10 includes a pair of opposed side walls 12, 14 connected to opposite side edges of a bottom wall 16, and a pair of end walls 18, 20 connected to opposite end edges of the bottom wall 16. Together, the side walls 12, 14 and the end walls 18, 20 interconnect to define an outer perimeter of the bag 10, and the bottom wall 16 encloses one end of the perimeter to define the bag compartment C1. As used herein, the term perimeter refers to the outer limits or boundary of the substantially closed plane structure defined by the side and end walls of the bag 10. A pair of handle straps 22, 24 is connected in proximity to the upper edge 26 of the bag compartment C1 to facilitate carrying the bag 10. The bag 10 may further include a frame (not shown) and may be formed from substantially rigid materials to reinforce or otherwise provide additional structural integrity.

FIGS. 2-7 illustrate the organizer insert 100 as a first embodiment of the present disclosure. The organizer insert 100 is configurable to fit inside of the bag 10 and is expandable to conform to the dimensions of a larger bag (not shown). Thus, the organizer insert 100 is particularly useful as a handbag insert. More specifically, the organizer insert 100 includes a pair of side walls 102, 104 that are intended to extend along the side walls 12, 14 of the bag 10, an expandable bottom wall 106 that is intended to rest upon the bottom wall 16 of the bag, and a pair of end walls 108, 110 that are intended to extend along the end walls 18, 20 of the bag 10. Together, the side, end, and bottom walls define an insert compartment C2 that is substantially smaller than the bag compartment C1, so that the organizer insert 100 fits inside the bag 10.

Figure 6:
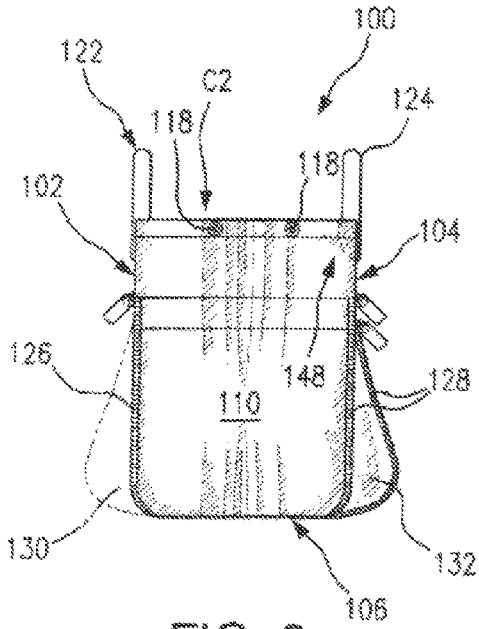
FIG. 6 is an end elevational view of the organizer insert of FIG. 1, shown with its bottom wall having been partially expanded.
Figure 7:
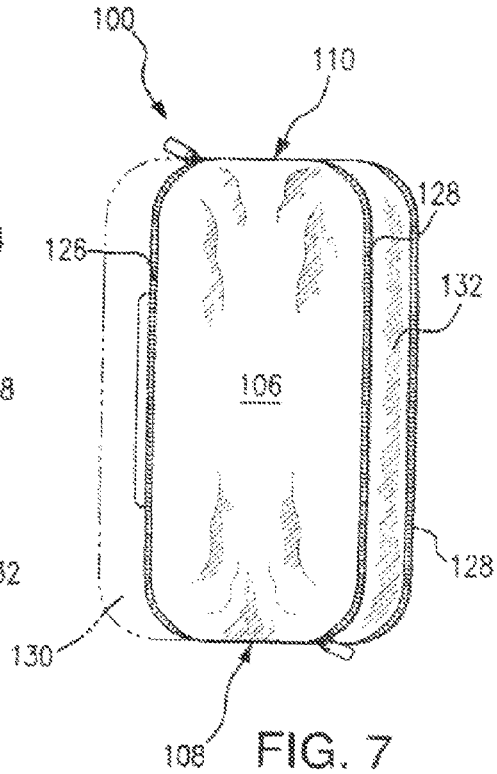
FIG. 7 is a bottom plan view of the organizer insert of FIG. 1, shown with its bottom wall having been partially expanded.

As mentioned above, the organizer insert 100 is expandable. To that end, a pair of expansion panels 130, 132 contiguously extending between the opposite pair of side walls 102, 104 and bottom wall 106 and the pair of end walls 108, 110 is provided for operatively moving the organizer insert 100 between a collapsed position and an expanded position. A pair of expansion fasteners 126, 128 in connection the bottom wall 106 and side walls 102, 104 is usable for stowing the expansion panels 130, 132 in the collapsed position and releasing the expansion panels 130, 132 into the expanded position, as shown in FIGS. 6 and 7. The expansion fasteners 126, 128 shown are slide fasteners, such as metal or plastic zippers, which enable the user to quickly and easily stow or unstow the expansion panels 130, 132 to increase the width of the organizer insert 100. However, any suitable fastener is contemplated, including but not limited to, VELCRO strips and the like.

As used herein, the term fastener refers to any known or yet to be developed means for at least temporarily fixing the relative position of objects or parts, closing an opening, or for joining together two objects or parts at least initially intended to be separate. Examples of suitable fasteners include, but are not limited to, hook and loop closures, catches, hasps, clasps, latches, buckles, clips, clamps, magnetic closures, slide fasteners such as zippers and profiled linkages, reusable adhesives, and pressure sensitive closures.

Each end wall 108, 110 may further include a releasable fastener 116, 118 for stowing the end walls 108, 110. While the embodiment shown in the drawings is a snap, any suitable releasable fastener is contemplated, such as a hook and loop fastener and a button fastener. The releasable fastener 116, 118 reversibly joins the side edges of the end walls 108, 110 so as to cause the end wall 108, 110 to gusset inwardly or outwardly to reduce the width of the end wall 108, 110. As one alternative, the end walls 108, 110 may blouse out somewhat in the expanded state, and may include corner straps (not shown) to tighten the end walls 108, 110 against the side walls 102, 104.

The organizer insert 100 also includes at least one insert handle 122, 124 as means for lifting the organizer insert 100 in and out of the bag 10, and may be structured as a pair of straps connected along the upper edge 120 of the organizer insert 100. The insert handle 122, 124 may be visible and accessible without extending above the upper edge 26 of the bag 10, unless visibility outside the bag 10 is desired.

Adjustability of the organizer insert 100 is particularly useful to reduce the tendency of the organizer insert 100 to slide around on the bottom wall 16 of the bag 10. To further secure position of the organizer insert 100 with respect to the bag compartment C1, the organizer insert 100 may be anchored in some fashion, such as with a hook and loop fastener strip between the respective bottom walls 16, 106.

Figure 3:
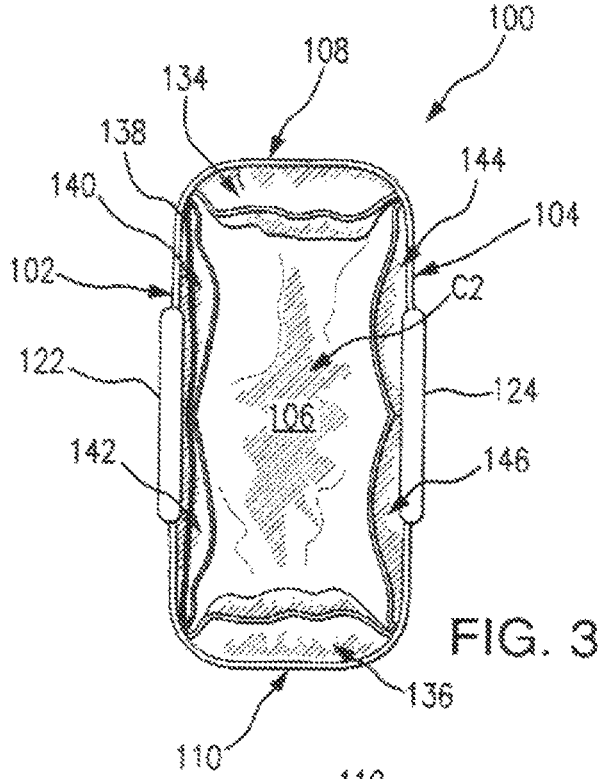
FIG. 3 is a top plan view of the organizer insert of FIG. 1.
Figure 4:
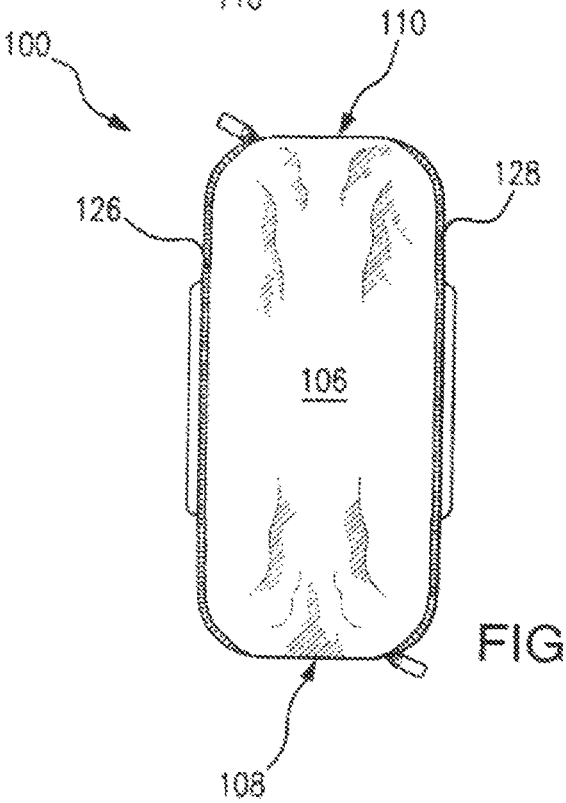
FIG. 4 is a bottom plan view of the organizer insert of FIG. 1.
Figure 5:
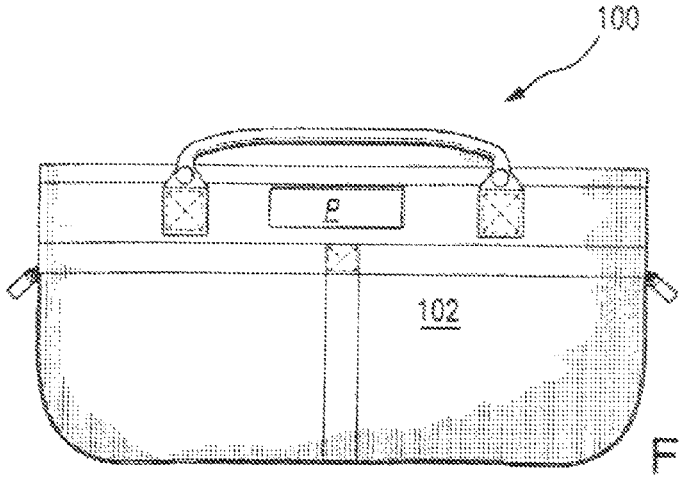
FIG. 5 is a front elevational view of the organizer insert of FIG. 1.

The organizer insert 100 includes a number of means for positioning objects that would generally be carried freely within the bag in absence of the organizer insert 100. Referring specifically now to FIG. 3, means for positioning objects include a number of interior pouches 134, 136, 138, 140, 142, 144, 146 secured inside of the insert compartment C2. Interior pouches 134, 136 are secured along the end walls 108, 110 and are particularly useful for positioning and receiving frequently used or large objects such as eyeglasses and cases therefore, beverage bottles, car keys, and the like. Interior pouch 138 is a zipper pouch that may extend entirely along the side wall 102, and is particularly useful for enclosing small objects, objects that are easily damaged, objects that are accessed less often, and objects that are more personal. A change purse (not shown) may be secured to inside of the interior pouch 138 or elsewhere. Interior pouches 140, 142 also secured along the side wall 102 and interior pouches 144, 146 secured along the side wall 104 are particularly useful for objects for which easy accessibility is desired, such as small wallets or change purses, compacts, lipstick, cell phones, chewing gum and mints, business card holders, and the like. An elongated sleeve 148 may be included to holster thin objects such as writing and makeup pens.

The organizer insert 100 may also include means for positioning objects on the exterior of the organizer insert 100. For example, the exemplary organizer insert 100 includes exterior pouches 150, 152.

The organizer insert 100 is substantially freestanding in that when removed from the bag 10, the organizer insert will substantially retain its shape when resting on its bottom wall 106. To that end, any or all of the side walls 102, 104, bottom wall 106, and end walls 108, 110 may be formed of or include an additional panel of a substantially rigid material, such as plastic or paperboard.

The present disclosure has been illustrated in relation to particular embodiments which are intended in all respects to be illustrative rather than restrictive. Those skilled in the art will recognize that the present disclosure is capable of many modifications and variations without departing from the scope of the disclosure. For example, as used herein, directional references such as "top", "base", "bottom", "end", "side", "inner", "outer", "upper", "middle", "lower", "front" and "rear" do not limit the respective walls of the carton to such orientation, but merely serve to distinguish these walls from one another. Any reference to hinged connection should not be construed as necessarily referring to a junction including a single hinge only; indeed, it is envisaged that hinged connection can be formed from one or more potentially disparate means for hingedly connecting materials. Any of the embodiments may be constructed of any suitable material, including satin, microfiber, leather, plastic, suede, woven fabric, and the like.

Those skilled in the art will also appreciate that the characteristics of the bags described herein are not intended to be limiting, but rather simply provide context for the environment of the disclosure. In addition, any suitable materials and closure devices may be used in addition to or instead of zippers and snaps, including magnets, non-permanent adhesives, or hook and loop fasteners such as VELCRO®, which is a trademark registered to Velcro Industries B.V. Accordingly, the scope of the present disclosure is described by the claims appended hereto and supported by the foregoing.

While the present invention has been shown and described in accordance with several preferred and practical embodiments, it is recognized that departures from the instant disclosure and fully contemplated within the spirit and scope of the present invention which is not to be limited except as defined in the following claims as interpreted under the Doctrine of Equivalence.

What is claimed is:

1. A transferable insert for organizing the interior of a bag having side walls and end walls to define a width and a length of the interior of the bag, said transferable insert comprising:

a pair of side walls, a pair of end walls and a bottom wall substantially continuously interconnected so as to define an interior storage compartment, a continuous upper edge defined along a top of said pair of side walls and said pair of end walls, and said continuous upper edge surrounding a top opening of the transferable insert that is disposed in communication with the interior storage compartment for allowing unobstructed access to the interior storage compartment, and said pair of side walls, said pair of end walls and said bottom wall being sized, structured and configured to allow the transferable insert to be removeably received within the interior of the bag;

a first expansion panel being operatively moveable between a collapsed position and an expanded position to conform to the width of the interior of the bag, wherein said first expansion panel contiguously extends between a first one of said pair of side walls and a first side of a first one of said pair of end walls, the first one of said pair of side walls and a first side of said bottom wall, and the first one of said pair of side walls and a first side of a second one of said pair of end walls;

a second expansion panel being operatively moveable between a collapsed position and an expanded position to conform to the width of the interior of the bag, wherein said second expansion panel contiguously extends between a second one of said pair of side walls and a second side of the first one of said pair of end walls, the second one of said pair of side walls and a second side of said bottom wall, and the second one of said pair of side walls and a second side of the second one of said pair of end walls;

a first expansion fastener structured and disposed for holding said first expansion panel stowed in the collapsed position and being operable to release said first expansion panel to the expanded position;

a second expansion fastener structured and disposed for holding said second expansion panel stowed in the collapsed position and being operable to release said second expansion panel to the expanded position;

said pair of side walls each including a panel of a substantially rigid material for retaining a freestanding shape of the transferable insert; and a plurality of pouches within said interior storage compartment for holding and positioning a plurality of objects therein in an organized arrangement.

2. The transferable insert as recited in claim 1 further comprising:

a releasable fastener on each of said pair of end walls, said releasable fastener being structured and disposed for releasably holding one of said pair of end walls in a gusseted position.

3. The transferable insert as recited in claim 2 wherein said releasable fastener is a snap fastener.

4. The transferable insert as recited in claim 1 wherein said first and second expansion fasteners are zippers.

5. The transferable insert of claim 1 further comprising:

at least one handle member for lifting the transferable insert out of the interior of the bag.

6. The transferable insert of claim 1 further comprising:

a pair of handle members for lifting the transferable insert out of the interior of the bag.

7. The transferable insert of claim 6 wherein said pair of handle members includes a first handle member and a second handle member each associated with at least one of said pair of side walls and said pair of end walls.

8. A transferable insert for organizing the interior of a bag having side walls and end walls to define a width and a length of the interior of the bag, said transferable insert comprising:

a pair of side walls, a pair of end walls and a bottom wall substantially continuously interconnected so as to define an interior storage compartment, a continuous upper edge defined along a top of said pair of side walls and said pair of end walls, and said continuous upper edge surrounding a top opening of the transferable insert that is disposed in communication with the interior storage compartment for allowing unobstructed access to the interior storage compartment, and said pair of side walls, said pair of end walls and said bottom wall being sized, structured and configured to allow the transferable insert to be removeably received within the interior of the bag;

a first expansion panel being operatively moveable between a collapsed position and an expanded position to conform to the width of the interior of the bag, wherein said first expansion panel contiguously extends between a first one of said pair of side walls and a first side of a first one of said pair of end walls, the first one of said pair of side walls and a first side of said bottom wall, and the first one of said pair of side walls and a first side of a second one of said pair of end walls;

a second expansion panel being operatively moveable between a collapsed position and an expanded position to conform to the width of the interior of the bag, wherein said second expansion panel contiguously extends between a second one of said pair of side walls and a second side of the first one of said pair of end walls, the second one of said pair of side walls and a second side of said bottom wall, and the second one of said pair of side walls and a second side of the second one of said pair of end walls;

a first expansion fastener structured and disposed for holding said first expansion panel stowed in the collapsed position and being operable to release said first expansion panel to the expanded position;

a second expansion fastener structured and disposed for holding said second expansion panel stowed in the collapsed position and being operable to release said second expansion panel to the expanded position;

a releasable fastener on each of said pair of end walls, said releasable fastener being structured and disposed for releasably holding one of said pair of end walls in a gusseted position;

said pair of side walls each including a panel of a substantially rigid material for retaining a freestanding shape of the transferable insert; and a plurality of pouches within said interior storage compartment for holding and positioning a plurality of objects therein in an organized arrangement.

9. The transferable insert as recited in claim 8 wherein said releasable fastener is a snap fastener.

10. The transferable insert as recited in claim 8 wherein said first and second expansion fasteners are zippers.

11. The transferable insert of claim 8 further comprising:

at least one handle member for lifting the transferable insert out of the interior of the bag.

12. The transferable insert of claim 8 further comprising:

a pair of handle members for lifting the transferable insert out of the interior of the bag.

13. The transferable insert of claim 12 wherein said pair of handle members includes a first handle member and a second handle member each associated with at least one of said pair of side walls and said pair of end walls.

* * * * *